US005170898A

United States Patent [19]

Katz et al.

[11] Patent Number: 5,170,898

[45] Date of Patent: Dec. 15, 1992

[54] I-BEAM FIXTURE SYSTEM

[75] Inventors: David Katz, Friendsville, Pa.; Gerald Fremderman; Paul Iooss, both of Binghamton, N.Y.

[73] Assignee: Kason Industries Inc., Binghamton, N.Y.

[21] Appl. No.: 759,787

[22] Filed: Sep. 10, 1991

Related U.S. Application Data

[63] Continuation of Ser. No. 653,591, Feb. 11, 1991, abandoned, which is a continuation of Ser. No. 538,352, Jun. 14, 1990, abandoned, which is a continuation of Ser. No. 397,828, Aug. 22, 1989, abandoned, which is a continuation of Ser. No. 281,602, Dec. 9, 1988, abandoned, which is a continuation of Ser. No. 128,678, Dec. 4, 1987, abandoned.

[51] Int. Cl.[5] ..... A47F 5/00

[52] U.S. Cl. ..... 211/193; 248/245

[58] Field of Search ..... 211/193; 248/245, 248

[56] References Cited

U.S. PATENT DOCUMENTS

| | | | |
|---|---|---|---|
| 844,367 | 2/1907 | Knape | 248/248 |
| 2,940,718 | 6/1960 | Beal | 248/245 |
| 2,997,269 | 8/1961 | Urbain et al. | 248/245 |
| 3,811,575 | 5/1974 | Boegehold | 248/245 X |
| 3,848,844 | 11/1974 | Barrett | 248/245 |
| 4,403,703 | 9/1983 | Nikles | 211/193 |
| 4,614,273 | 9/1986 | Ishii | 248/245 X |

*Primary Examiner*—Robert W. Gibson, Jr.
*Attorney, Agent, or Firm*—Paul J. Sutton

[57] ABSTRACT

The present invention teaches a modular fixture (also sometimes in the trade referred to as fixture-ware) system, the features of which include and are characterized by the user's ability to set the system up and "knock it" down without the need of tools. This attractive and unique fixture system includes one or more lockable bracket assemblies which may be lockably positioned at any one or more of several locking positions, while at the same time facilitating locking at any of a substantially infinite number of positions. At least one vertical support member is formed with what may to some look like an I-type beam configuration. The differences between this configuration and an actual conventionally used I-beam, however, are apparent. The bracket assemblies include non-vertical portions adapted to support hanging articles, such as by way of example only, clothing, which may be on hangers. The system facilitates the use of a variety of bracket assemblies, as well as combinations of vertical support members which, together, form a variety of display configurations.

6 Claims, 4 Drawing Sheets 10
12
14
15
24
26
30
34
42
44
46
50
56
58
60
66
68
72
74
82
84
86
88
98
110

I-BEAM FIXTURE SYSTEM

This is a continuation of application Ser. No. 07/653,591 filed Feb. 11, 1991, now abandoned which is a continuation of Ser. No. 538,352, filed Jun. 14, 1990, now abandoned. Ser. No. 538,352 is a continuation of application Ser. No. 397,828 filed Aug. 22, 1989 and now abandoned. Ser. No. 397,828 is a continuation of application Ser. No. 281,602 filed Dec. 9, 1988 and now abandoned. Ser. No. 281,602 is a continuation of application Ser. No. 128,678 filed Dec. 4, 1987 and now abandoned.

BACKGROUND OF THE INVENTION

The present invention relates generally to fixture systems capable of supporting clothing or articles hung therefrom, and more particularly to a modular fixture or fixture-ware system capable of assembly and disassembly, or even adjustment, by the user without the need of special or even conventional tooling.

The use of fixtures or fixture-ware in store design, particularly retail stores offering clothing to the consumer, is well known. Kason Industries, Inc. has been a leader in the field, for many years offering to the trade its proprietary "Chrome Dimension" brand product line which has included tubing, with which a number of shelves and hanger accessories are used. It is important here to emphasize that the system according to the present invention, and the environment within which it may be used, is not limited to fixture-ware from which only clothing is hung or supported. Shelving, wall dividers, display and merchandising units, furniture, components, mirrors, panels, showcases, and racks are but examples of types of point-of-purchase or other uses to which fixture-ware contemplated by the present invention can be put.

A need has existed for an attractive, reasonably priced fixture or fixture-ware "system" which the user is able to assemble or erect, without the need of tools, and which reliably exhibits the strength and rigidity qualities important in this field. Efforts to meet this need have resulted in hardware and products which exhibit less than optimum functional and appearance characteristics.

SUMMARY OF THE INVENTION

It is an object of the present invention to meet this need and to overcome disadvantages of conventional fixture or fixture-ware products.

An object of the present invention is to provide a system of non-horizontal and non-vertical supporting members which cooperate with one another to provide a true modular system capable of assembly and disassembly, without the need for special or other types of tools.

A further object of the present invention is to provide a fixture system with which the user is able to relatively easily assemble one or more horizontal members in a level configuration, with the aid of indicia comprising part of the present invention.

Yet another object is to provide such a system, wherein only hand-tightening is required to produce a relatively stable, rigid structure capable of supporting and displaying a variety of products of varying shape and weight.

Still a further object of this invention is to provide such a system wherein elements or components are interchangeable with one another, this facilitating a modular or building-block effect wherein any number of different assemblies may be created or substituted at the will of the user.

Another object of the present invention is to provide such a fixture system, which permits retailers to fully express their aesthetic ideas in a relatively flexible and functional manner, in the form of structures.

Yet a further object is to provide such a system, wherein substantially the entire length of a vertical support member according to the present invention may be utilized in attaching one or more bracket assemblies which, in turn, are slidably positionable and fixable such that a stable and rigid support structure of predetermined or independently created configurations is assembled.

The present invention fills the aforementioned needs, and overcomes disadvantages and limitations of prior art attempts to solve problems in this field, by providing in a relatively broad context a fixture system including, in its basics, at least one support member formed with an elongated first bearing surface located relatively opposite a pair of opposing bearing surfaces, these surfaces serving to define an elongated groove, and a locking bracket assembly movably positionable at different elevations in said groove and being cooperative with the support member, and including lateral portions formed with a pair of spaced bearing portions, and locking means for moving the bearing portions to and into binding contact with the bearing surfaces of the support member such that the bracket assembly is securely fixed at any of a number of predetermined locations.

BRIEF DESCRIPTION OF THE DRAWING

The present invention will be better understood by reading the present specification in conjunction with the drawings, wherein similar reference characters denote similar elements throughout the several views, and wherein.

DESCRIPTION OF THE PREFERRED EMBODIMENT

Figure 1:
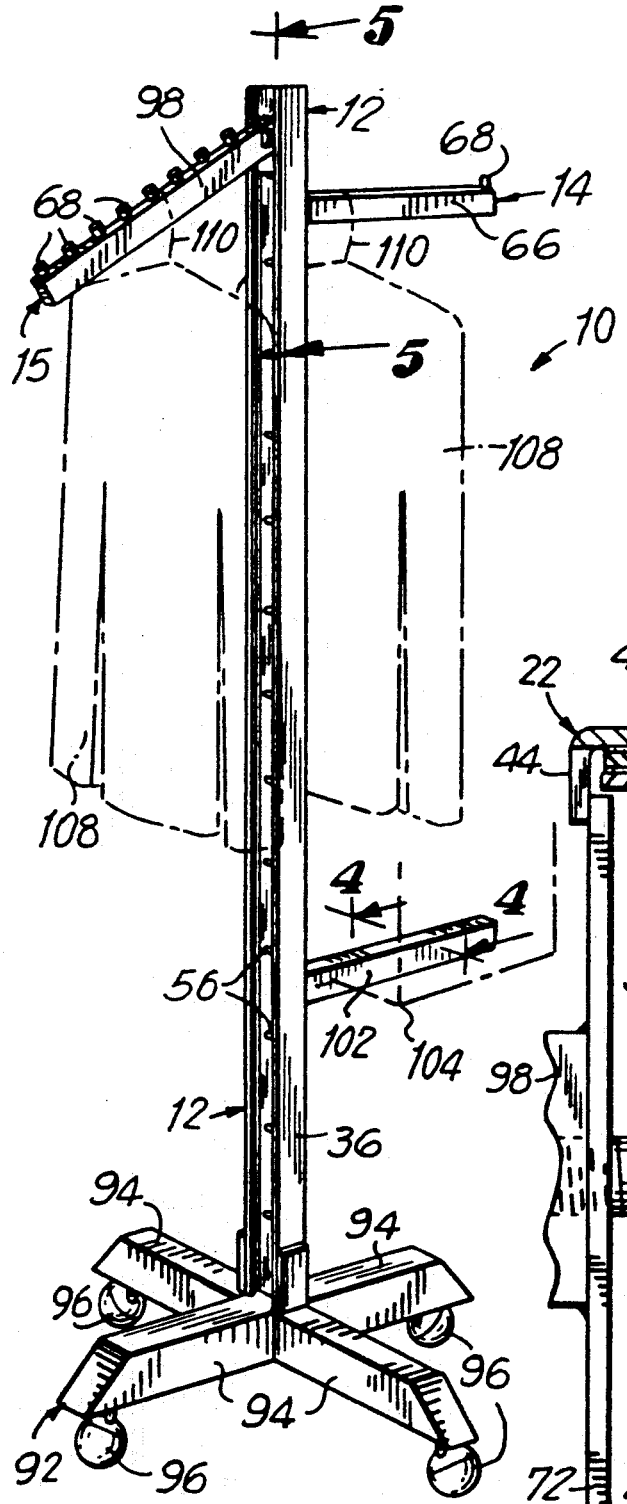
FIG. 1 is an upper left perspective view of one of several possible embodiments of the system according to the present invention.

Referring now in more detail to the drawings, a system 10 according to the present invention is shown in FIG. 1 in the form of a single upright fixture utilizing the I-beam concept according to the present invention. It is contemplated by this invention to include at least one and usually more (but not necessarily a plurality) of vertical, or what may herein be referred to as a non-horizontal, support members 12 with which one or more bracket assemblies 14 cooperate. Thus, while FIG. 1 illustrates but a single upright, many varieties of configurations with several uprights are contemplated as coming within the scope of the present invention.

Figure 7:
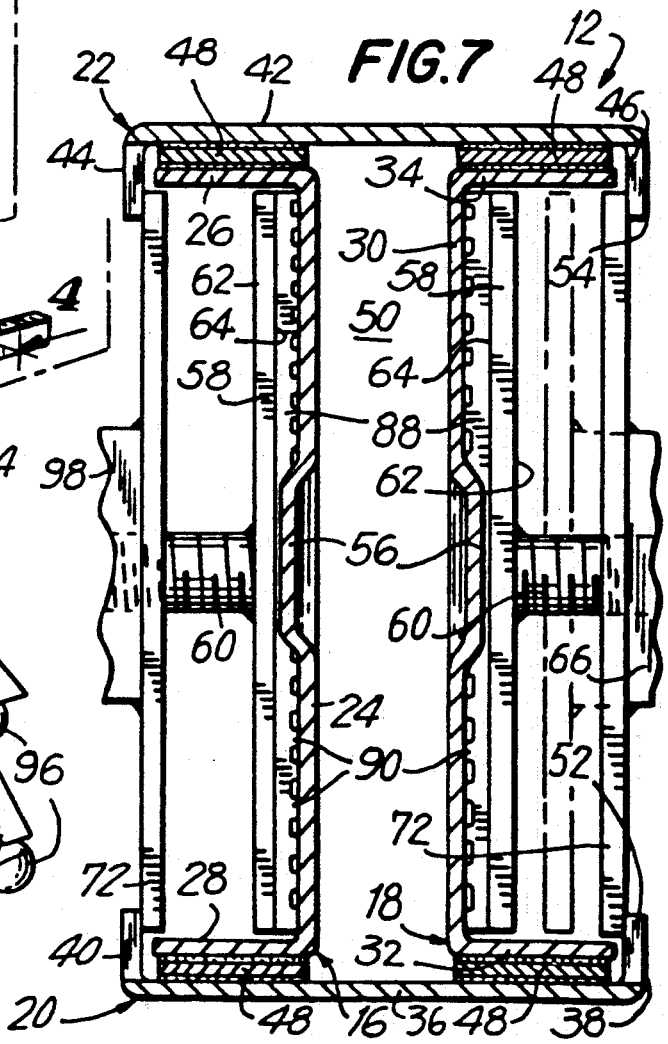
FIG. 7 is a sectional plan view taken along the line 7—7 of FIG. 6.
Figure 3:
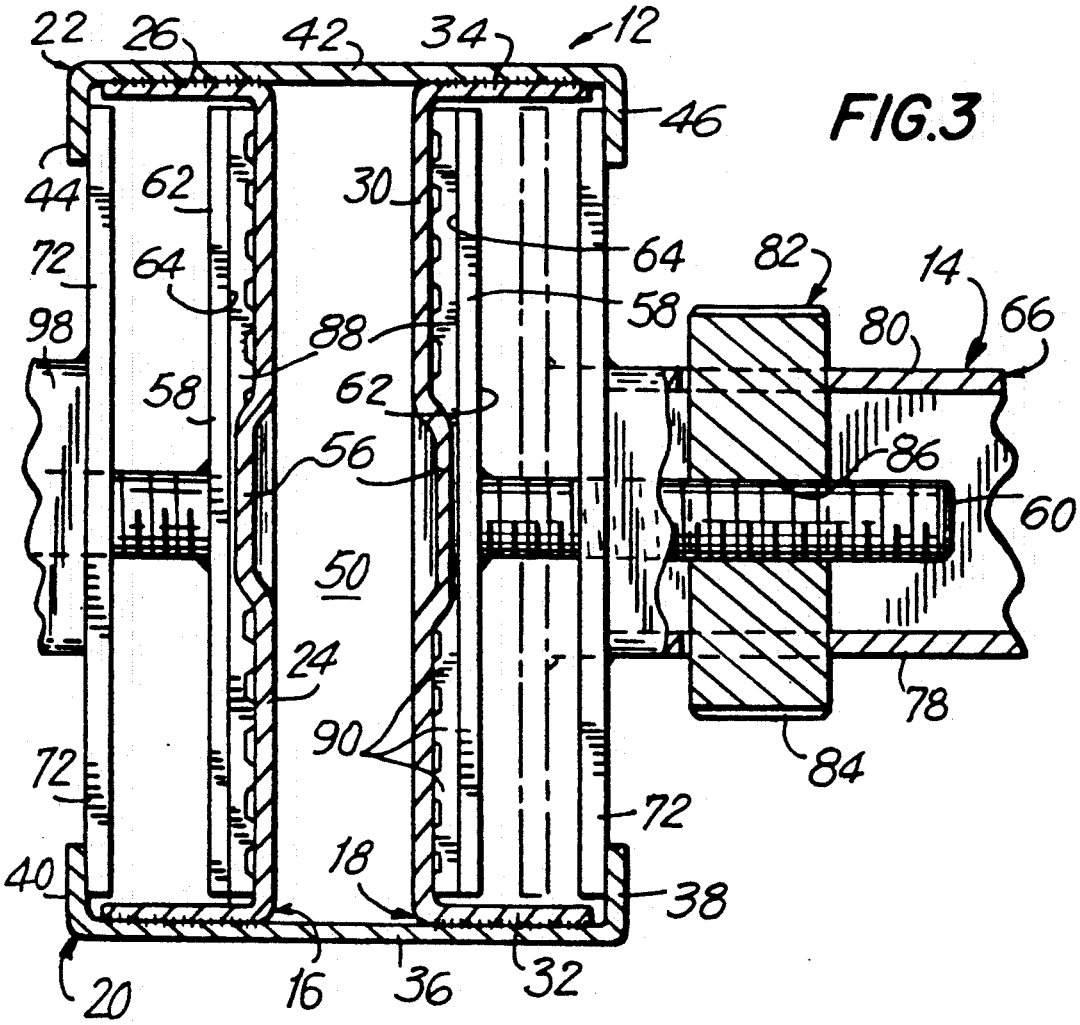
FIG. 3 is a sectional plan view taken along line 3—3 of FIG. 2.

In a preferred embodiment of the present invention, such as is utilized in the structure of FIG. 1, a support member 12 assumes what will sometimes be referred to as an I-beam configuration, made up of a pair of relatively internal channel members 16 and 18, and a pair of relatively external channel members 20 and 22. As best seen in FIGS. 3 and 7, internal channel member 16 is formed with a substantially central web 24 integral with opposing legs 26 and 28. Similarly, internal channel member 18 is formed with a substantially central web 30 integral with opposing legs 32 and 34.

External channel member 20 is formed with a substantially central web 36 integral with opposing legs 38 and 40, while external channel member 22 is formed with a substantially central web 42 integral with opposing legs 44 and 46. Internal and external channel members 16, 18, 20, and 22 are joined together by means of either spot welding or another type of welding, or by means of double-sided tape or for that matter an adhesive 48 located between the legs 26, 28, 32 and 34 of internal channel members 16 and 18 and inner surfaces of webs 36 and 42 of external channel members 20 and 22.

Figure 2:
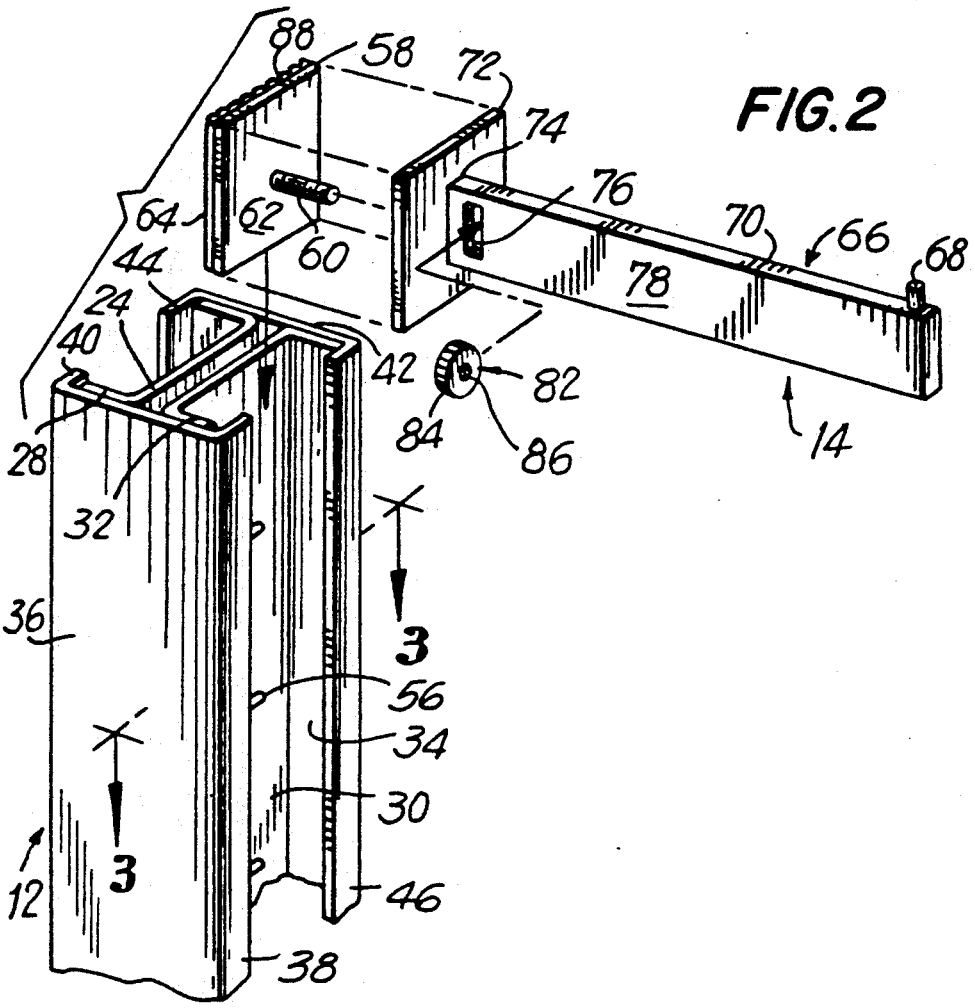
FIG. 2 is an exploded-type perspective view of a bracket assembly according to the present invention and its associated vertical support member.
Figure 6:
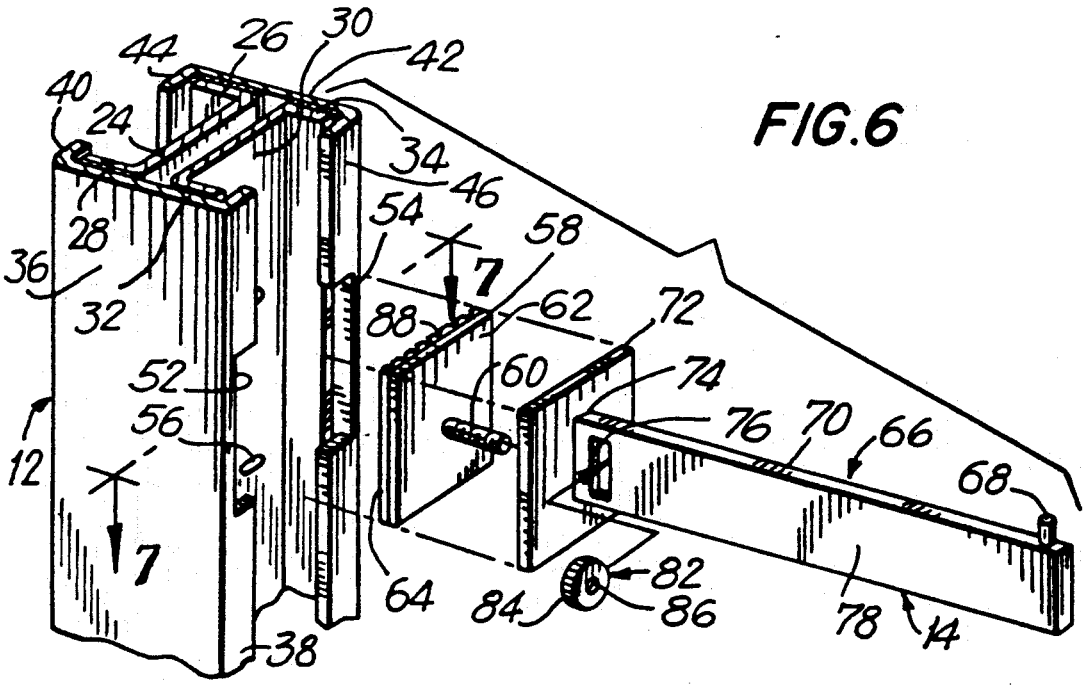
FIG. 6 is a view similar to FIG. 2, illustrating in exploded fashion the relative positions of the bracket assembly and its associated vertical support member, in connection with their joinder.
Figure 5:
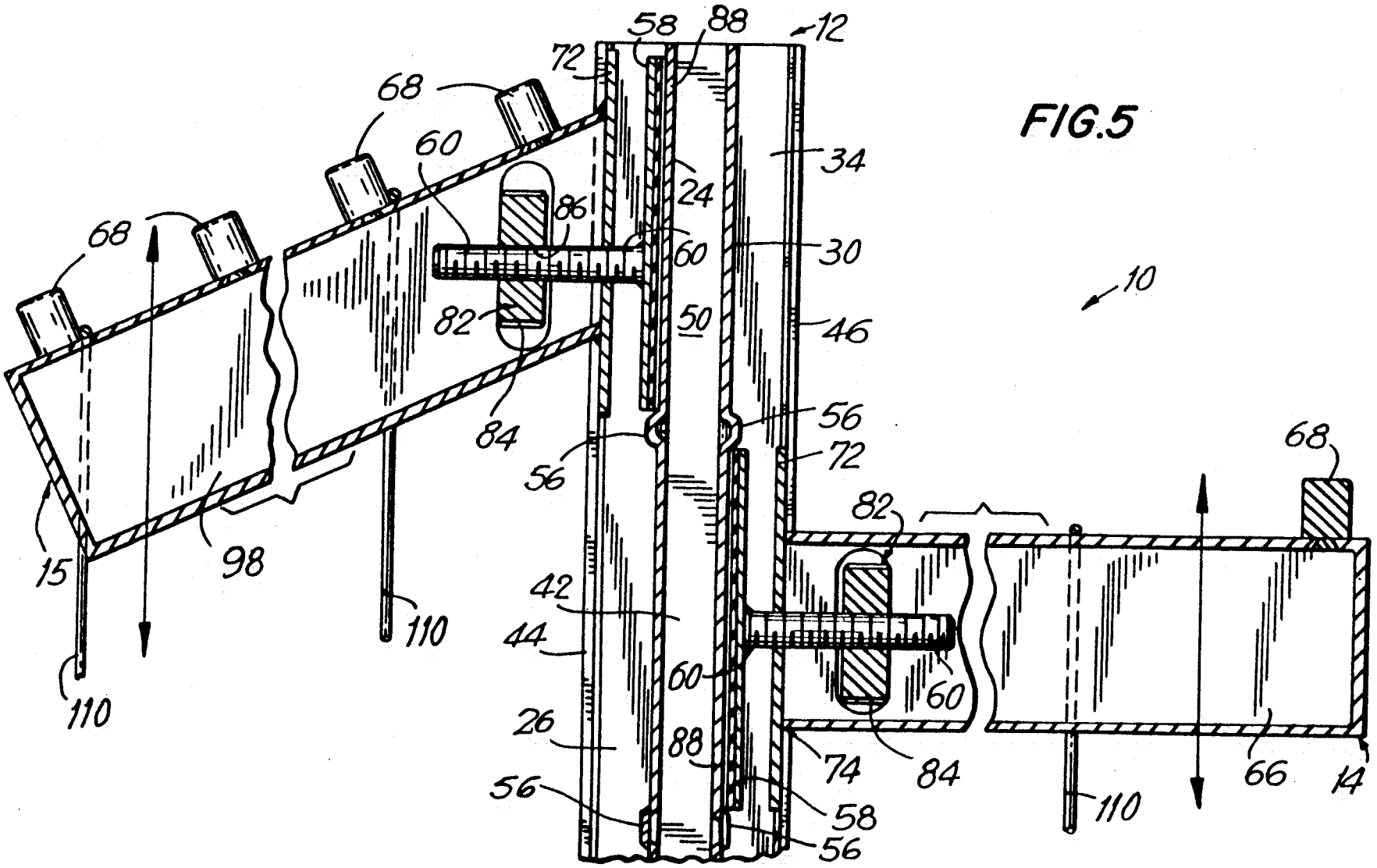
FIG. 5 is a sectional elevational view taken along line 5—5 of FIG. 1.

The result is the formation of a generally I-shaped beam, seen in FIGS. 2, 5 and 6, whose internal web is made up of internal channel members 16 and 18, with a central cavity or space 50 extending therebetween, and with outer I-beam flanges defined by external channel members 20 and 22. Legs 38 and 46 are each formed with slots 52 and 54 at a predetermined location generally midway or in their respective central portions. Likewise, legs 40 and 44 are formed with similar slots to provide a similar overall opening on the opposite side of the support member 12.

Webs 24 and 30 of internal channel members 16 and 18, respectively, are each further formed with a plurality of substantially equally spaced and centrally disposed protrusions 56 formed by indentations in the rearward surfaces thereof which partly define cavity 50. While the shape of protrusions 56 may vary, in a preferred embodiment of this invention, protrusions 56 comprise relatively elongated edges extending substantially transversely with respect to the longitudinal axis of webs 24 and 30, ending at each side in generally semi-circular ends. Protrusions 56 extend sufficiently from the surfaces of webs 24 and 30 to provide relatively upper and lower bearing shoulder surfaces which face one another in step fashion along the length of the beam. Their function will be made apparent further below in this specification.

The length(s) of vertical support member(s) 12 may be varied to suit the needs of the retailer. Stock lengths, such as 60 and 96 inches are believed to satisfy many or most needs, while yielding the versatility facilitated by the present system.

Reference to FIG. 1 will indicate that two distinct shapes or types of bracket assemblies are illustrated, namely, a "straight-arm" bracket assembly 14 and a "slanted-arm" or inclined-arm bracket assembly 15. But for the angle which they form with vertical support member 12, their operation is basically the same and will herein be described in detail with respect to "straight" bracket assembly 14.

Bracket assembly 14 consists of an adjustment plate 58 of generally rectangular shape and approximately 3/32 inches in thickness, with rounded corners approximately of ⅛ inch radii. These dimensions are presented by way of example only, and are not meant to limit the lawful scope of the present invention. Other variations of shape and size are contemplated as coming within the scope of the invention.

A threaded stud 60 extends from forward surfaces 62 of adjustment plate 58, and is secured to the plate by means of tungsten inert gas (TIG) welding or other suitable attachment means. Rearward plate surfaces 64 are generally smooth, to permit sliding, as will be discussed below. Stud 60 is preferably 5/16 inches in diameter, and is substantially centrally located in plate 58.

A bracket arm 66 is constructed of tubing of generally rectangular cross section. According to our invention, a "family" of bracket arms of either straight, slanted or biased, or any desired shapes is contemplated as being cooperatively mounted on or secured to vertical support member(s) 12. For illustration purposes, bracket arm 66 is depicted as being substantially straight, with an upstanding retaining dowel 68 of either round or polygonal cross section extending from upper arm surface 70.

A bracket plate 72 is secured by means of welding, for example, to end 74 of bracket arm 66. Bracket plate 72 is of a size and shape generally corresponding to that of adjustment plate 58. Bracket arm 66 is further formed with an opening 76 formed through sides 78 and 80 to permit location of an adjustment nut 82 at least partially therewithin. Nut 82 is preferably cylindrical in overall shape, with knurled outer gripping surfaces 84 extending substantially coaxially about a central, female threaded opening 86 which, in turn, is matingly compatible with threaded stud 60.

When assembled, bracket assembly 14 comprises adjustment plate 58 and its threaded stud 60 secured to adjacent and movable toward and away from bracket plate 72 by means of rotation of adjustment nut 82 located with its central threaded opening 86 disposed within opening 76 in bracket arm 66. The result is an assembly 14 which may be manipulated by the user.

An additional preferred element of bracket assembly 14 is an elastomeric or rubber pad 88, which is secured by means of an adhesive to the rearward surfaces of adjustment plate 58. Rubber pad 88 is preferably, but not necessarily formed with horizontally extending ribs 90, calculated during use to frictionally engage, in a non-slip manner, the inner surfaces of webs 24 and 30 of inner channel members 16 and 18, respectively.

Ribs 90 are illustrated in the drawings as extending vertically, just to demonstrate the flexibility afforded by the elements of the invention, however in use it is intended that ribs 90 be oriented horizontally to permit greater anti-sliding friction as a result of greater interference with protrusions 56.

At the risk of being repetitious, but so as not to limit in the mind of the reader the intended scope of protection being sought, neither the protrusions nor the ribs 90 are necessary for the concept of the present invention to function.

In use, bracket assembly 14 is added to support member 12 as follows: the adjustment plate 58 is added to bracket arm 66 and its associated elements by inserting the adjustment nut 82 into opening 76 formed through sides 78 and 80 of arm 66; and threaded stud 60 is inserted into the open end of the tubing of arm 66 until it matingly engages and is caused to enter opening 86 of nut 82 by the user's clockwise rotation of nut 82 via knurled surfaces 84.

Once adjustment plate 58 and its front surfaces 62 are proximate or touching bracket plate 72 (see FIG. 3), both assembled plates 58 and 72 may be inserted through the overall rectangular opening defined by slots 52 and 54 in legs 38 and 46 of external channel members 20 and 22 (FIG. 6). While the upper end of vertical support member 12 is usually, but not necessarily closed off or capped for aesthetic reasons, there may be situations where it is open, in which case these plates 58 and 72 may be inserted into the vertically extending groove through the open end (FIG. 2).

By "vertically extending groove", the reader is referred to the fact that such a groove is defined by the inwardly facing surfaces of web 30, legs 32 and 34, legs 38 and 46, and the portions of webs 36 and 42 relatively near legs 38 and 46. The same is true on the opposite side of the vertical I-beam, wherein a vertically extending groove is defined by web 24, legs 26 and 28, legs 40 and 44, and the portions of webs 36 and 42 near legs 40 and 44.

Once plates 58 and 72 (and their associated bracket arm 66) are so positioned within said vertical groove at any point other than at the location of slots 52 and 55, a turning of adjustment nut 82 in a counter-clockwise direction (viewed from the opposite free end of arm 66) causes adjustment plate 58 to move away from bracket plate 72 until the ribs 90 of rubber pad 88 attached to rearward surfaces 64 of adjustment plate 58 come into contact with the surfaces of web 30, and the relatively lateral or left and right side edge surfaces of bracket plate 72 come into contact with those inner surfaces of legs 38 and 46 which face web 30. Further finger tightening of adjustment nut 82 in said counter-clockwise direction causes binding or locking of the plates 58 and 72 against said contacted surfaces, with the result that arm 66 is securely and reliably positioned at an elevation desired by the user.

According to the present invention, by providing the protrusions 56 along webs 24 and 30, the aforesaid locking of plates 58 and 72 and their associated arm 66 is greatly enhanced as follows: By positioning adjustment plate 58 at any elevation wherein the upper and lower edges of plate 58 lie between any pair of protrusions 56, and locking plates 58 and 72 at such locations, the physical interference thus created between the edges of plate 58 and these protrusions yields incredible strength and resistance to forces tending to move the locked bracket assembly 14 within the I-beam vertical groove.

Not only must the frictional engagement forces be overcome in order to move assembly 14, but an actual shearing of a protrusion 58 or of threaded stud 60 is necessary to so move bracket assembly 14-something not possible within the realm of foreseeable forces to be applied to the bracket assembly. The strength of this joinder of bracket assembly 14 to vertical support member 12 using merely finger tightening forces on adjustment nut 82 are sufficient to support hundreds and perhaps thousands of pounds of load applied to arm 66.

The result is a highly efficient, unexpectedly strong and rigid structure from or on which clothing or any of the aforementioned products may be hung or supported. At this point in this specification, the reader's attention is directed to FIG. 1 again, wherein system 10 illustrates verical support member 12 mounted atop a movable base assembly 92, consisting of four outwardly extending feet or legs 94, themselves supported atop casters 96 for ease in moving the entire structure between desired locations.

In addition to the horizontally extending bracket arm 66 already described in some detail above, FIG. 1 illustrates a slanted bracket arm 98 extending at an acute angle from the vertical support member beneath it. Slanted bracket arm 98 is mounted to support member 12 in the same manner as described for arm 66, and preferably includes a plurality of upstanding retaining dowels or protrusions which will prevent gravity-induced bunching of hung garments sliding to the lowest elevation. Our invention contemplates any number of variations of this theme, including, without limitation, bracket arms which hold between them one or more display containers or other desired items. It should also now be obvious that the structure created by the elements of the present invention exhibits an exceptionally pleasing and unique appearance, with and without items being supported therefrom.

Figure 4:
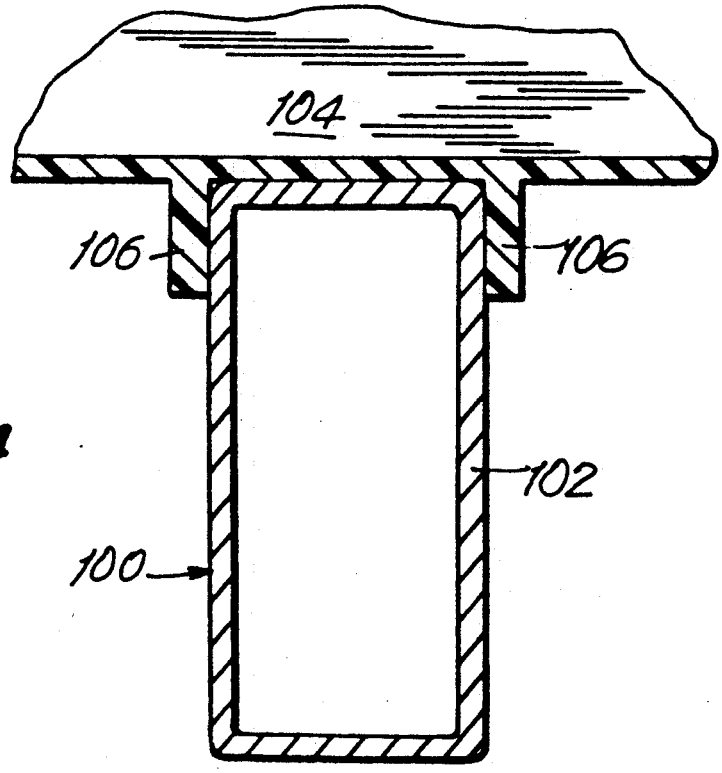
FIG. 4 is a sectional plan view taken along line 4—4 of FIG. 1.

Reference to FIG. 1 indicates a third bracket assembly 100, including a straight arm 102, which has been included in system 10 merely to illustrate within a single figure of the drawings additional capabilities of the present invention. Bracket assembly 100 is much like the bracket assemblies 14 and 15, and as best seen in FIG. 4, may be used at a lower elevation to support one or more containers or display units, illustrated in fragmentary broken lines 104 in FIG. 1, and in full lines in FIG. 4. By way of example only, display unit 104 is formed with depending ribs or legs 106 which straddle arm 102, with or without contact between the legs 106 and arm 102, to provide a relatively stable single-arm support.

To assist the reader, the drawings include in phantom or broken line outline examples of clothing 108 on hangers 110 which, as also seen in FIG. 5, are able to be positioned in several locations upon the bracket assemblies described herein.

The embodiments of the invention disclosed and described in the present specification and drawings and claims are presented merely as examples of the invention. Other embodiments, forms and modifications thereof will suggest themselves to those skilled in the art from a reading thereof and are contemplated as coming within the scope of the present invention.

What is claimed is:

1. A fixture system comprising:

a support structure comprising a pair of internal channel members, each of said internal channel members comprising a central wall and two side walls integral therewith and extending substantially parallel to each other from opposite ends of said central wall, and a pair of external channel members, each of said external channel members comprising a central wall and two side walls integral therewith and extending substantially parallel to each other from opposite ends of said central wall, said structure being configured such that said central walls of said pair of internal channel members are spaced apart and substantially parallel to each other and said two side walls of one of said internal channel members extend in substantially opposite directions from said two side walls of the other of said internal channel members, and said central walls of said pair of external channel members are spaced apart and substantially parallel to each other, and substantially perpendicular to said central walls of said internal channel members, to the respective ends of which they are joined, and said two side walls of said external channel member extend substantially toward said two side walls of the other said external channel member, said support structure being configured such that each of said external channel members has its central wall extending past the respective ends of the side wall of said pair of internal channel members and the side walls of said outer channel members each extend past an end of a side wall of a respective inner channel member;

the inwardly facing surfaces of said central wall and said side walls of one of said pair of internal channel members, together with the inwardly facing surfaces of a respective side wall of each said external channel member and a portion of the inwardly facing surface of each said center wall of each external channel member, each said portion being adjacent to a said side wall of said external channel member, together defining a first groove;

the inwardly facing surfaces of said central wall and said side walls of another of said pair of internal channel members, together with the inwardly facing surfaces of another respective side wall of each said external channel member and a portion of the inwardly facing surface of each said center wall of each external channel member each said portion being adjacent to another side wall of said external channel member, together defining a second groove;

a locking bracket assembly mountable in said first or second grooves of said support structure, said locking bracket assembly comprising an adjustment plate, a bracket plate spaced apart from and substantially parallel to said adjustment plate, means connectable to said adjustment plate and said bracket plate for varying the distance therebetween such that said adjustment plate is brought into contact with a center wall of an inner face of an internal channel member in one of said grooves and said bracket plate is brought into abutment with respective inner faces of side walls of said external channel members opposite said center wall, and a bracket arm integral with said bracket plate and extending outwardly from said bracket plate.

2. The fixture system of claim 1 wherein at least some of said side walls of said external channel members have recesses therein for facilitating mounting of said locking bracket assembly in one or both of said first and second grooves.

3. The fixture system of claim 1 further comprising an aperture in said bracket plate and an adjustment nut seated in an opening in said bracket arm and aligned with said aperture and wherein said means for varying the distance between said adjustment plate and said bracket plate comprises a threaded stud integral with and extending outward from said adjustment plate which fits within said aperture in said adjustment plate and in said adjustment nut such that rotation of said adjustment nut varies the distance between said adjustment plate and said bracket plate.

4. The fixture system of claim 1 further comprising a plurality of protrusions extending outwardly from said center walls of said internal channel members into said grooves such that said adjustment plate of said locking bracket assembly can be positioned between any pair of adjacent protrusions to prevent sliding of the locking bracket assembly within one of said grooves.

5. The fixture system of claim 1 further comprising an elastomeric pad attached to a rearward surface of said adjustment plate for frictionally engaging one of said center walls of said internal channel members.

6. The fixture system of claim 5 wherein said elastomeric pad comprises a plurality of ribs.

* * * * *